US009765966B2

(12) United States Patent
Herzog et al.

(10) Patent No.: US 9,765,966 B2
(45) Date of Patent: Sep. 19, 2017

(54) IGNITION SWITCH ASSEMBLY

(71) Applicant: ILLINOIS TOOL WORKS INC., Glenview, IL (US)

(72) Inventors: Richard R. Herzog, Arlington Hts, IL (US); Michael W. Hartley, Elmhurst, IL (US)

(73) Assignee: Illinois Tool Works Inc., Glenview, IL (US)

( * ) Notice: Subject to any disclaimer, the term of this patent is extended or adjusted under 35 U.S.C. 154(b) by 361 days.

(21) Appl. No.: 14/434,774

(22) PCT Filed: Sep. 17, 2013

(86) PCT No.: PCT/US2013/060065
§ 371 (c)(1),
(2) Date: Apr. 10, 2015

(87) PCT Pub. No.: WO2014/065957
PCT Pub. Date: May 1, 2014

(65) Prior Publication Data

US 2015/0285495 A1 Oct. 8, 2015

Related U.S. Application Data

(60) Provisional application No. 61/716,657, filed on Oct. 22, 2012.

(51) Int. Cl.
*H01H 9/06* (2006.01)
*F23Q 3/00* (2006.01)
(Continued)

(52) U.S. Cl.
CPC ..... *F23Q 3/006* (2013.01); *F01M 11/0004* (2013.01); *F23Q 3/008* (2013.01);
(Continued)

(58) Field of Classification Search
CPC ..... H01H 19/60; H01H 19/62; H01H 19/605; H01H 3/0206; F24C 3/103
(Continued)

(56) References Cited

U.S. PATENT DOCUMENTS 3,971,904 A * 7/1976 Ward ..... F24C 3/103 200/303
4,019,855 A * 4/1977 Camillo ..... F24C 3/103 126/39 E
(Continued)

OTHER PUBLICATIONS

ISR and WO for PCT/US2013/060065 dated Apr. 17, 2014.

*Primary Examiner* — Vanessa Girardi
(74) *Attorney, Agent, or Firm* — Joseph M. Butscher; The Small Patent Law Group, LLC

(57) ABSTRACT

An ignition switch assembly is configured to be operatively connected to a gas valve. The ignition switch assembly may include a first ignition contact and a second ignition contact. The first and second ignition contacts may be sized and shaped the same. A hub may be configured to be rotated within the ignition switch assembly. A rotation of the hub in a first direction causes a portion of the first ignition contact to engage the second ignition contact. Further rotation of the hub in the first direction or rotation of the hub in a second direction that is opposite from the first direction causes the portion of the first ignition contact to disengage from the second ignition contact.

24 Claims, 15 Drawing Sheets

(51) Int. Cl.

| | |
|---|---|
| ***H01H 1/18*** | (2006.01) |
| ***H01H 3/42*** | (2006.01) |
| ***H01H 9/04*** | (2006.01) |
| ***H01H 19/06*** | (2006.01) |
| ***H01H 19/08*** | (2006.01) |
| ***H01H 19/20*** | (2006.01) |
| ***H01H 19/36*** | (2006.01) |
| ***H01H 19/62*** | (2006.01) |
| ***H01H 1/06*** | (2006.01) |
| ***F01M 11/00*** | (2006.01) |
| *H01H 1/14* | (2006.01) |

(52) U.S. Cl.
CPC ..... *H01H 1/06* (2013.01); *H01H 1/18* (2013.01); *H01H 3/42* (2013.01); *H01H 9/04* (2013.01); *H01H 19/06* (2013.01); *H01H 19/08* (2013.01); *H01H 19/20* (2013.01); *H01H 19/36* (2013.01); *H01H 19/62* (2013.01); *H01H 2001/145* (2013.01)

(58) Field of Classification Search
USPC ..... 200/43.03, 61.86, 569, 6 B, 6 BB, 574; 431/256; 126/39 E
See application file for complete search history.

(56) References Cited

U.S. PATENT DOCUMENTS

| | | | |
|---|---|---|---|
| 7,902,476 | B2 | 3/2011 | Querejeta Andueza et al. |
| 8,173,924 | B2 * | 5/2012 | Tegel ..... H01H 1/585 200/564 |
| 2006/0042925 | A1 | 3/2006 | Gjerde |
| 2009/0321231 | A1 | 12/2009 | Tegel et al. |

* cited by examiner

IGNITION SWITCH ASSEMBLY

RELATED APPLICATIONS

This application is a national phase of International Application Number PCT/US2013/060065 filed Sep. 17, 2013 and relates to and claims priority benefits from U.S. Provisional Patent Application No. 61/716,657 filed Oct. 22, 2012, which is hereby incorporated by reference in its entirety.

FIELD OF EMBODIMENTS OF THE DISCLOSURE

Embodiments of the present disclosure generally relate to an ignition switch assembly, such as may be used with gas ranges and ovens.

BACKGROUND

Various appliances are fueled through gas, such as natural gas or propane. For example, a gas range may include burners that are in close proximity to one or more ignition switches. The ignition switches are used to ignite the gas burners. Typically, an ignition switch activates an igniter as gas begins to flow to a particular burner. However, switch circuits do not always accurately and effectively ignite gas flowing to a burner. Moreover, a typical ignition switch, as it is engaged by a control knob, may exert too much torque in relation to the control knob, thereby providing an undesirable feel when turning the control knob. Further, the ignition switch typically shorts if liquid is spilled onto the ignition switch.

In general, an ignition switch includes switch contacts that are mounted parallel to one another. When the ignition switch is engaged, surface areas of the contacts engage one another. Over time, and with increased exposure to certain elements, contamination and/or oxidation may occur. Some contacts have a bend at the tip, which results in an edge-to-surface contact with another contact. Such contact causes a slight scraping action during engagement, which cleans contamination on the surface of the engaged contact. However, the bends in the contacts lead to manufacturing variation and adversely affect switching accuracy. The manufacturing variation increases the costs to produce the ignition switches, while the reduced switching accuracy may decrease the longevity of the ignition switches and/or cause switch failure.

SUMMARY OF EMBODIMENTS OF THE DISCLOSURE

Certain embodiments of the present disclosure provide an ignition switch assembly configured to be operatively connected to a gas valve. The ignition switch assembly may include first and second ignition contacts and a hub configured to be rotated. The first and second ignition contacts may be sized and shaped the same. A rotation of the hub in a first direction causes a portion of the first ignition contact to engage the second ignition contact. Further rotation of the hub in the first direction or rotation of the hub in a second direction that is opposite from the first direction causes the portion of the first ignition contact to disengage from the second ignition contact. The hub may include a camming protuberance configured to urge the portion of the first ignition contact into the second ignition contact.

The first and second ignition contacts may be angled with respect to one another when the first ignition contact is disengaged from the second ignition contact. For example, entire lengths or substantial portions of the lengths of the first and second ignition contacts may be non-parallel with respect to one another.

The first ignition contact may reside within a first linear plane in an at-rest position. Similarly, the second ignition contact may reside within a second linear plane in an at-rest position.

Each of the first and second ignition contacts may include an anchoring end integrally connected to a fixed beam and a flexible beam. The anchoring end and the fixed beam are configured to be fixed in position within the ignition switch assembly. The portion of the first ignition contact may include the flexible beam.

The ignition switch assembly may also include a base secured to a cover. The base may be configured to mount to the gas valve. The base and the cover may define an internal chamber. The first and second ignition contacts and the hub may be retained within the internal chamber. In at least one embodiment, the first and second ignition contacts are securely retained by the cover, as opposed to the base.

The base may include a hub rotation alignment member including at least one protruding bulge. The hub may include at least one retaining feature having a reciprocal channel formed between two protuberances. The protruding bulge(s) nests within the reciprocal channel(s) to prevent undesired rotation of the hub with respect to the base.

The cover may also include an upstanding rim surrounding a portion of the hub. The upstanding rim is configured to direct liquid away from the hub. The cover may also include contact anchors, contact retainers, and tip retainers configured to retain each of the first and second ignition contacts at a plurality of points of contact.

An open drain path may be formed between the hub and the base. The open drain path is configured to allow liquid to drain through the ignition switch assembly so that the liquid does not contact the first and second ignition contacts.

The base may include one or both of a hub retainer and a hub rotation alignment member configured to axially secure the hub. The base may also include one or both of liquid-directing channels or barrier members configured to direct liquid away from the first and second ignition contacts.

Certain embodiments of the present disclosure provide an ignition switch assembly configured to be operatively connected to a gas valve. The ignition switch assembly may include a first ignition contact and a second ignition contact. The first and second ignition contacts may be linear and angled with respect to one another when the first and second ignition contacts are in at-rest positions.

Figure 1:
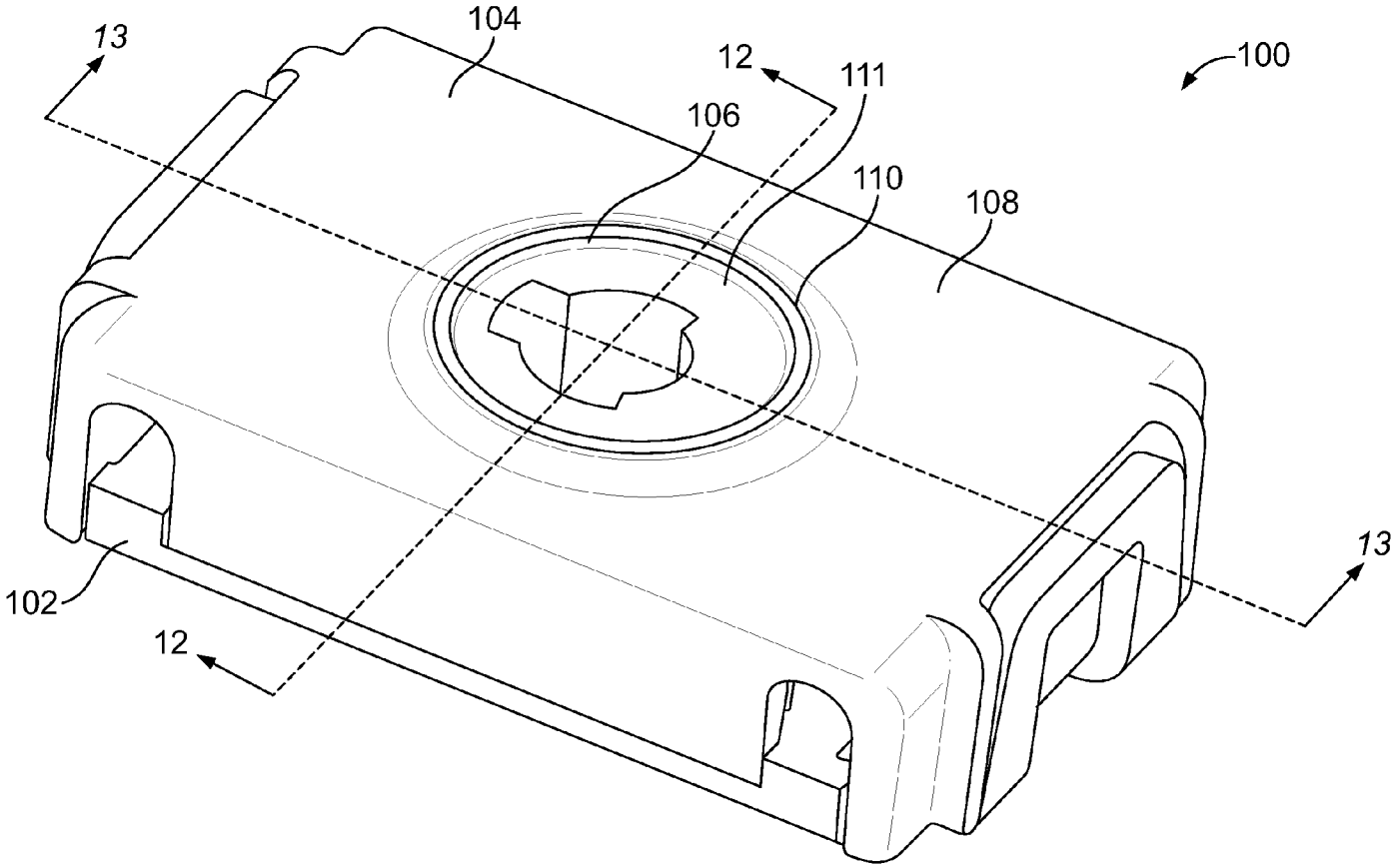
FIG. 1 illustrates an isometric top view of a switch assembly, according to an embodiment of the present disclosure.

Before the embodiments of the disclosure are explained in detail, it is to be understood that the disclosure is not limited in its application to the details of construction and the arrangement of the components set forth in the following description or illustrated in the drawings. The disclosure is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE DISCLOSURE

FIG. 1 illustrates an isometric top view of a switch assembly 100, according to an embodiment of the present disclosure. The switch assembly 100 may include a base 102 secured to a cover 104. For example, the base 102 may be removably secured to the cover 104, such as through a snapable, latchable, or other such removable connection. An internal chamber (hidden from view in FIG. 1) may be defined between the base 102 and the cover 104. A hub 106 is exposed through a top wall 108 of the cover 104 and is rotatably secured within the internal chamber. The hub 106 is rotatably secured within a hub opening 110 formed in the cover 104. The hub 106 is configured to operatively engage at least one ignition contact (hidden from view in FIG. 1) within the internal chamber. A top surface 111 of the hub 106 may be configured to operatively connect to a gas valve and/or a control knob of an appliance, for example.

Figure 2:
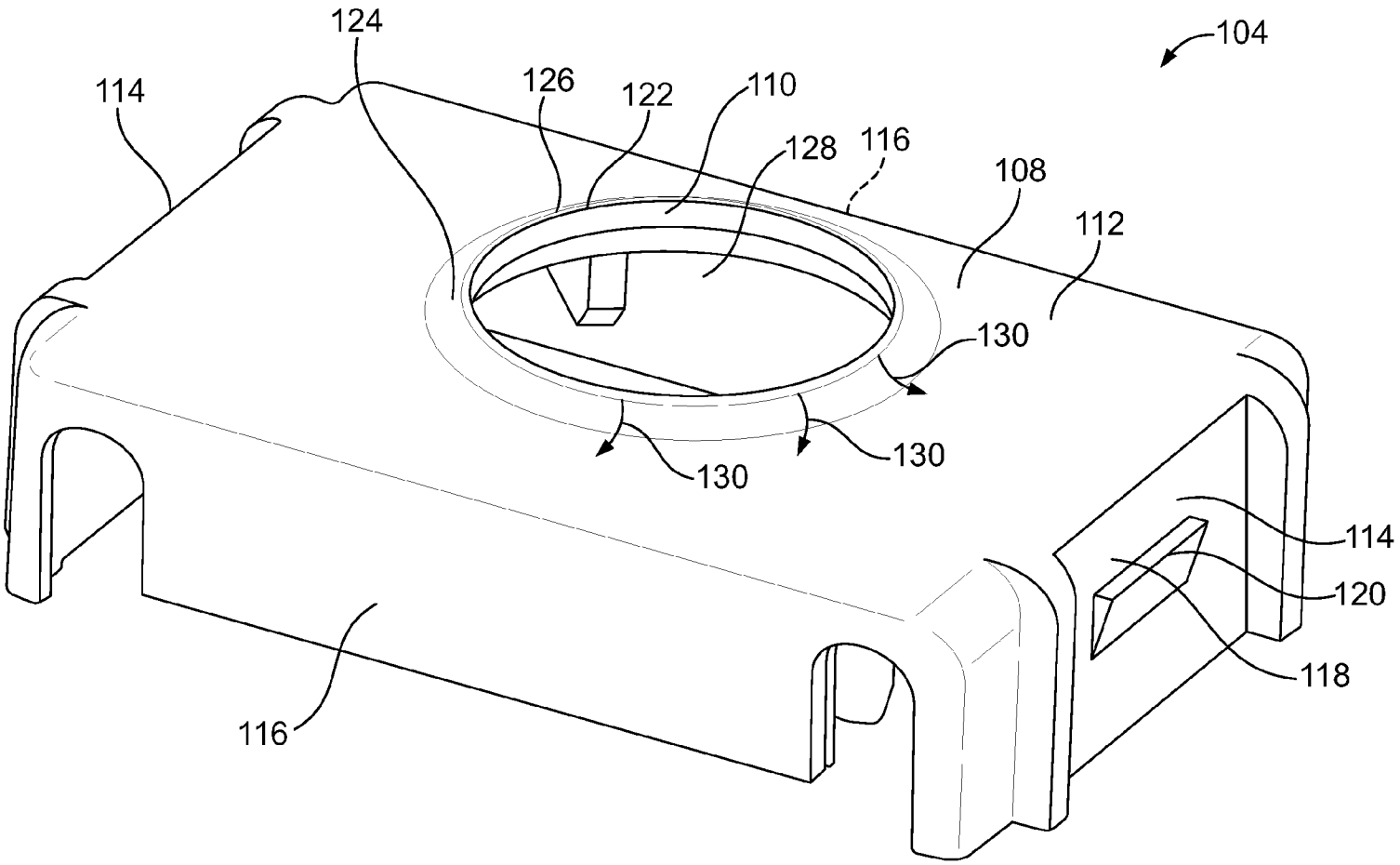
FIG. 2 illustrates an isometric top view of a cover, according to an embodiment of the present disclosure.

FIG. 2 illustrates an isometric top view of the cover 104, according to an embodiment of the present disclosure. The cover 104 may be formed of metal, plastic, or the like. The cover 104 includes a main body 112 defined by opposed ends 114 that are integrally connected to opposed sides 116 and the top wall 108. As shown, the ends 114 and the sides 116 may be generally perpendicular to the top wall 108. For example, the top wall 108 may be in a horizontal plane, while the ends 114 and the sides 116 may be in vertical planes.

Each end 114 may include a recessed area 118 configured to receive and retain ends of the base 102 (shown in FIG. 1). A base-securing protuberance 120, such as a ridge, latch, barb, or the like, may extend outwardly into the recessed area 118. The base-securing protuberance 120 is configured to securely engage the ends of the base 102, such as through a snapable or latchable engagement.

As noted above, the hub opening 110 may be formed through the top wall 108 of the cover 104. The hub opening 110 may include an upstanding rim 122 having a ramped edge 124 that ramps down from an upper rim portion 126 to the top wall 108. The upstanding rim 122 cooperates with the hub 106 (shown in FIG. 1) to prevent water and other liquids from infiltrating into an internal chamber 128. For example, the upstanding rim 122 directs water and liquid away from the hub opening 110 toward the top wall 108 in the directions of arrows 130, in contrast to allowing water and liquid to funnel into the hub opening 110.

As shown in FIG. 2, the hub opening 110 may generally be in the center of the top wall 108. Alternatively, the hub opening 110 may be positioned at various other portions of the top wall 108, such as closer and/or proximate to one of the ends 114 and/or one of the sides 116.

Figure 3:
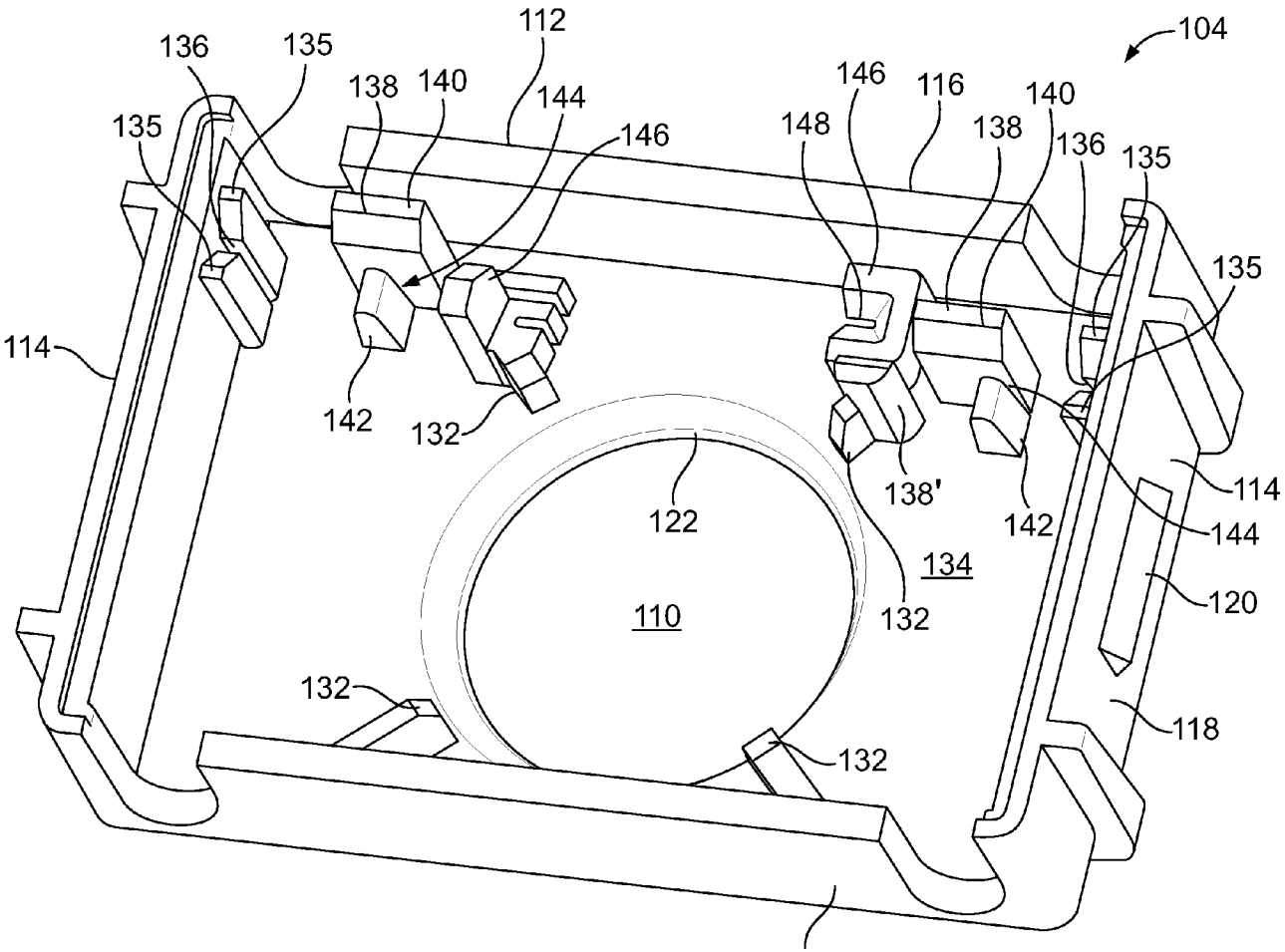
FIG. 3 illustrates an isometric bottom view of a cover, according to an embodiment of the present disclosure.

FIG. 3 illustrates an isometric bottom view of the cover 104, according to an embodiment of the present disclosure. Guide members 132 extend downwardly from a bottom surface 134 of the top wall 108. The guide members 132 are positioned around the hub opening 110. As shown in FIG. 3, four guide members 132 extend downwardly at regular spacing from the bottom surface 134. However, more or less guide members 132 may be used. Each guide member 132 may be a post, stud, block, and/or the like that is configured to guide the hub 106 (shown in FIG. 1) into proper alignment and position during an assembly process. Further, the guide members 132 cooperate to ensure that the hub 106 remains aligned after the assembly process.

Additionally, contact anchors 135 extend outwardly from internal surfaces of each end 114. For example, a pair of contact anchors 135 may extend from each end 114. A contact slot 136 is positioned between each pair of contact anchors 135. As shown in FIG. 3, the contact anchors 135 may be proximate to one side 116. However, the contact anchors 135 may be proximate to an opposite side 116. The contacts anchors 135 are configured to retain an anchoring end of an ignition contact within the contact slot 136.

Contact retainers 138 and 138' extend from the bottom surface 134 and are inboard (for example, closer to the center of the cover 104) from the contact anchors 135. Each contact retainer 138 may include an upstanding block 140 separated from a stud 142 by a gap 144 that is configured to receive a portion of an ignition contact, such as a retainer slot, as described below. The portion of the ignition contact is configured to be trapped between the block 140 and the stud 142, for example.

Tip retainers 146 extend from the bottom surface 134 and are inboard from the contact anchors 135. The tip retainers 146 may include a slot 148 configured to retain a tip portion of an ignition contact. In general, the contact retainers 138, 138' and the tip retainers 146 are configured to securely retain fixed beams of ignition contacts.

Figure 4:
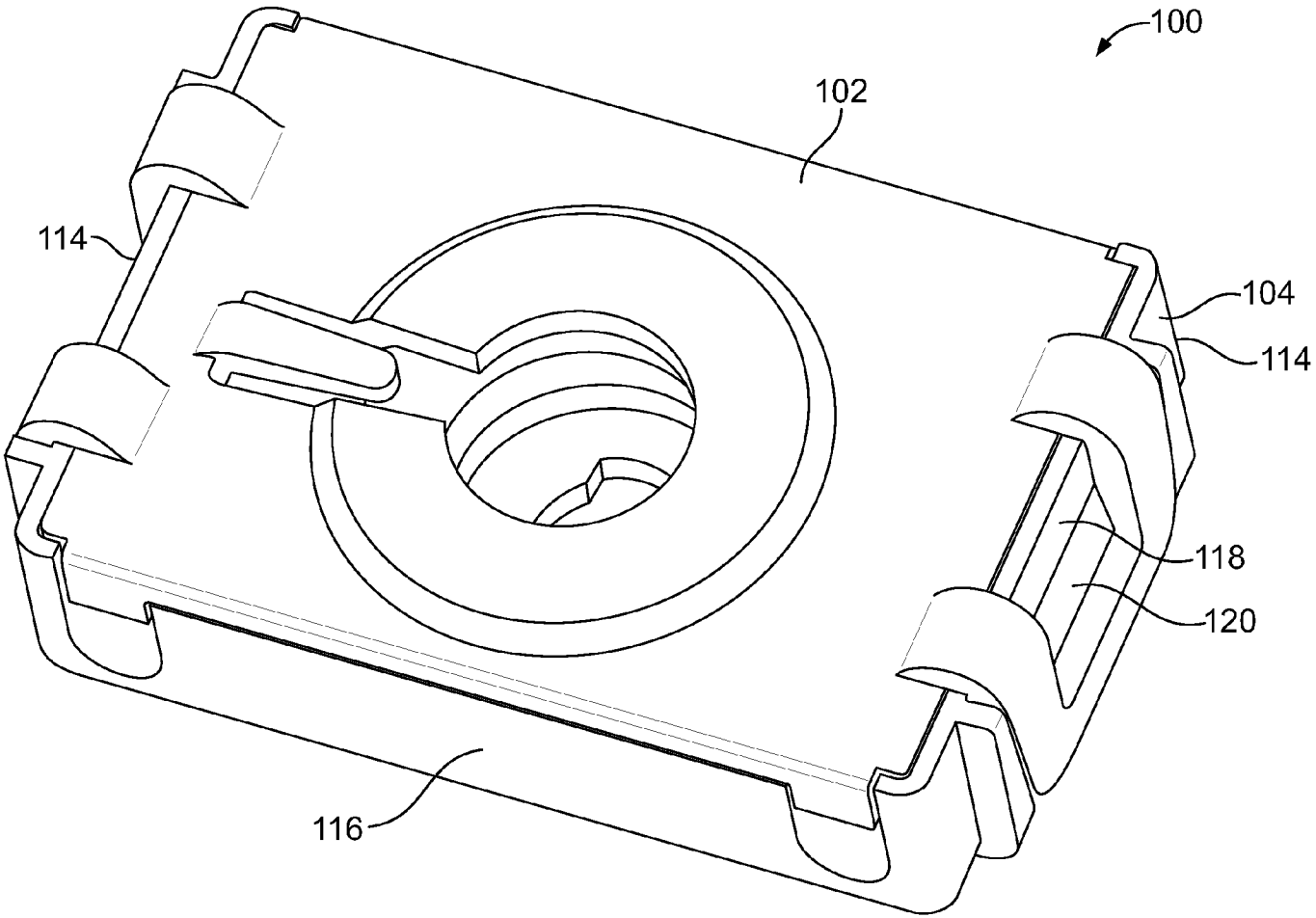
FIG. 4 illustrates an isometric bottom view of a switch assembly, according to an embodiment of the present disclosure.

FIG. 4 illustrates an isometric bottom view of the switch assembly 100, according to an embodiment of the present disclosure. As shown in FIG. 4, the base 102 secures to the cover 104.

Figure 5:
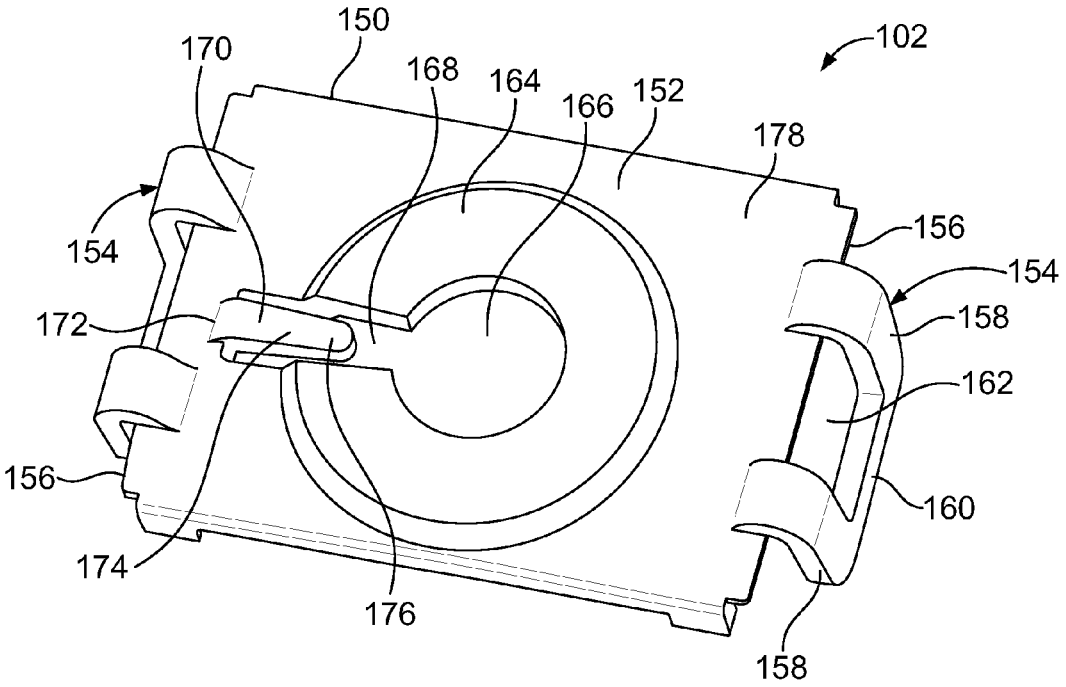
FIG. 5 illustrates an isometric bottom view of a base, according to an embodiment of the present disclosure.

FIG. 5 illustrates an isometric bottom view of the base 102, according to an embodiment of the present disclosure. The base 102 may be formed of plastic or metal, for example. The base 102 may include a main body 150 having a planar wall 152 and securing bars 154 extending upwardly from opposite ends 156 of the planar wall 152. Each securing bar 154 may include upstanding beams 158 that generally extend perpendicularly from the ends 156. The upstanding beams 158 connect to a cross beam 160 that is generally parallel with the planar wall 152. A space 162 is defined between the upstanding beams 158 and the cross beam 160. Each securing bar 154 is configured to be positioned within a recessed area 118 of the cover 104, as shown in FIGS. 1 and 4, for example, such that the base-securing protuberance 120 securely engages internal edges of the cross beam 160 and upstanding beams 158. For example, opposed securing bars 154 may snapably secure within the opposed recessed areas 118.

A circumferential hub retainer 164 may extend downwardly from the planar wall 152. The hub retainer 164 is configured to align with the hub opening 110 (shown in FIGS. 1-3) of the cover 104. As such, the hub retainer 164 and the hub opening 110 cooperate to rotatably secure the hub 106 (shown in FIG. 1) therebetween.

A central opening 166 is formed through the hub retainer 164. The central opening 166 connects to an open channel 168 radially extending from the central opening 166 and directed toward an end 156 of the base 102. A hub rotation alignment member 170 extends from the planar wall 152 into the open channel 168. The hub rotation alignment member 170 includes a base 172 flexibly connected to the planar wall 152. The base 172 connects an extension beam 174 that extends into the channel 168. The extension beam 174 connects to a distal tip 176 that extends into the channel 168.

As shown in FIG. 5, a bottom surface 178 of the base 102 may be flat and devoid of any mounting features configured to securely mate with reciprocal features of a gas valve, for example. Alternatively, the bottom surface 178 may include one or more mounting features configured to securely mate with reciprocal features of a gas valve.

Figure 6:
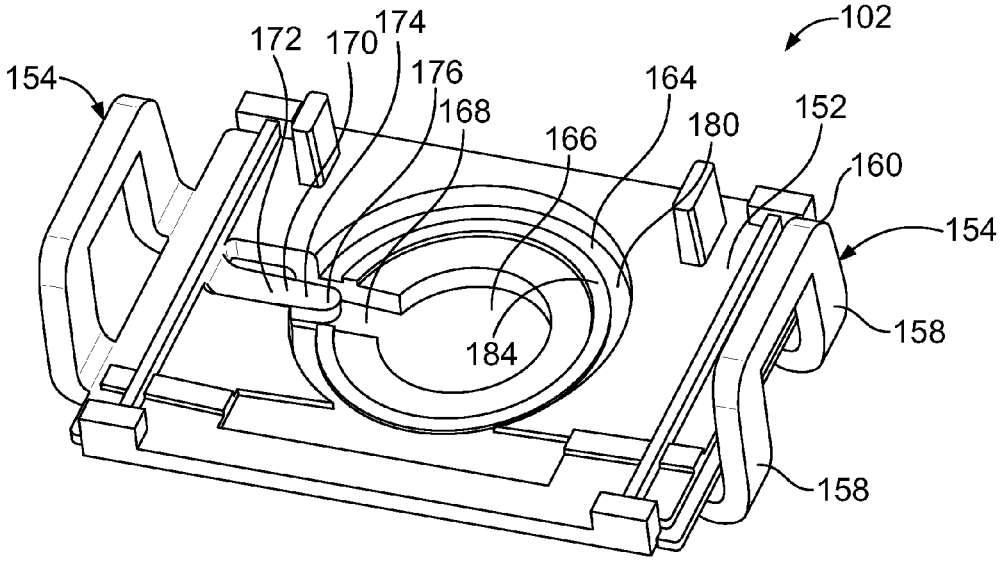
FIG. 6 illustrates an isometric top view of a base, according to an embodiment of the present disclosure.

FIG. 6 illustrates an isometric top view of the base 102, according to an embodiment of the present disclosure. The circumferential hub retainer 164 may include a recessed area 180 formed within a top surface 182 of the planar wall 152. A central circular guide rib 184 may extend upwardly from the top surface 182. The recessed area 180 is configured to rotatably retain a bottom end of the hub 106 (shown in FIG. 1). The guide rib 184 is configured to be mated into a reciprocal circumferential channel formed through the bottom end of the hub 106 to ensure that the hub 106 remains rotationally aligned with respect to the base 102. The hub rotation alignment member 170 is configured to slidably secure to a portion of the hub 106 to provide additional rotational securing alignment with the hub 106. Alternatively, the base 102 may not include the hub rotation alignment member 170 and/or the guide rib 184.

Figure 7:
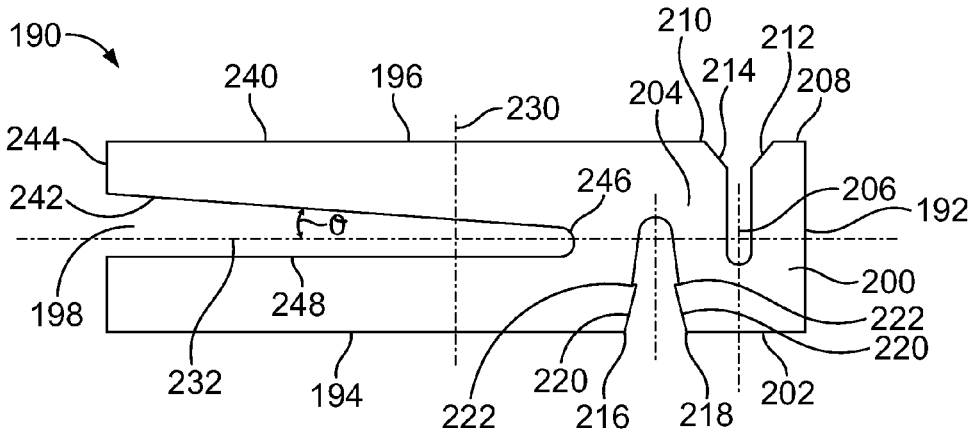
FIG. 7 illustrates a lateral view of an ignition contact, according to an embodiment of the present disclosure.

FIG. 7 illustrates a lateral view of an ignition contact 190, according to an embodiment of the present disclosure. The ignition contact 190 may be formed of metal. In an at-rest position, the ignition contact 190 is linear in that it is straight with no portions deviating from a linear plane. Instead, an entirety of the ignition contact 190 may reside within a single place. Optionally, a substantial amount of the length of the ignition contact 190 may reside within the single plane (such as for example, a small portion, for example, less than 10%, is bent out of plane). In such an embodiment in which a substantial amount of the length resides within the single plane, the ignition contact 190 may still be considered to be within the single plane. In at least one embodiment, the ignition contact 190 may be stamped from a linear sheet of metal.

The ignition contact 190 includes an anchoring end 192 integrally connected to a stationary fixed beam or finger 194 separated from a flexible beam or finger 196 by a longitudinal gap 198. The anchoring end 192, the fixed beam 194, and the flexible beam 196 may be formed within a single, common plane, such that no portion of the ignition contact 190 extends outside of the common plane, or only an insubstantial portion extends outside of the common plane. However, the flexible beam 196 is configured to flex into and out of the common plane, as described below.

The anchoring end 192 includes a retained beam 200 integrally connected to a lower base 202, which, in turn, connects to a transition beam 204. The retained beam 200 and a portion of the lower base 202 are configured to be secured to the cover 104 by a contact anchor 135 (shown in FIG. 3). A wire slot 206 extends from and between top edges 208 and 210 of the retained beam 200 and the transition beam 204, respectively. The wire slot 206 extends towards the lower base 202. The top edges 208 and 210 may include angled surfaces 212 and 214, respectively. The angled surfaces 212 and 214 cooperate to provide an expanded lead-in area configured to direct a conductive wire, for example, into the wire slot 206. When the wire is within the wire slot 206, electrical energy may be transferred therebetween.

As shown, the wire slot 206 extends downwardly from the top edges 208 and 210. A contact retainer slot 216 may upwardly extend from a lower edge 218 of the anchoring end 192. The contact retainer slot 216 is positioned on an opposite side of the transition beam 204 from the wire slot 206. The contact retainer slot 216 includes angled lead-in edges 220 that connect to securing barbs 222 configured to lock into reciprocal features formed in the contact retainers 138 (shown in FIG. 3). The contact retainer slot 216 is shaped to securely mate with a portion of the contact retainer 138 within the gap 144 formed between the upstanding block 140 and the stud 142 (shown in FIG. 3), for example. As shown, the wire slot 206 and the contact retainer slot 216 are parallel with a short axis 230, but perpendicular to a long axis 232 of the ignition contact 190.

The fixed beam 194 may be formed as a rectangular beam that extends from the anchoring end 192. The fixed beam 194 is generally aligned with the long axis 232, and perpendicular to the short axis 230. The fixed beam 194 is configured to be securely fixed to the cover 104 (shown in FIG. 1). The fixed beam 194 may be the same length as the flexible beam 196. Alternatively, the fixed beam 194 may be longer or shorter than the flexible beam 196.

The flexible beam 196 includes a top edge 240 that is parallel with the long axis 232, and perpendicular to the short axis 230. The flexible beam 196 includes an internal edge 242 that angles down from a tip 244 toward a transition curve 246 that connects to an upper edge 248 of the fixed beam 194. The internal edge 242 may be oriented at an angle θ between 0°-45° with respect to the long axis 232. Alternatively, the angle θ may exceed 45°. The internal edge 242 may be tapered as shown in FIG. 7 to evenly distribute stress along the length thereof. Optionally, the internal edge 242 may not be tapered, but instead may be parallel with the upper edge 248 of the fixed beam 194.

The anchoring end 192 is configured to be securely anchored to an end 114 of the cover 104 (shown in FIG. 3, for example). The fixed beam 194 is configured to be secured to the bottom surface 134 of the cover 104. As such, the ignition contact 190 is configured to be retained by the cover at multiple points of contact. However, upon exertion of a force of sufficient magnitude, such as exerted by a camming protuberance of the hub 106 (shown in FIG. 1), the flexible beam 196 is configured to flex into and out of a common plane with the fixed beam 194 when the ignition contact 190 is secured to the cover 104.

Figure 8:
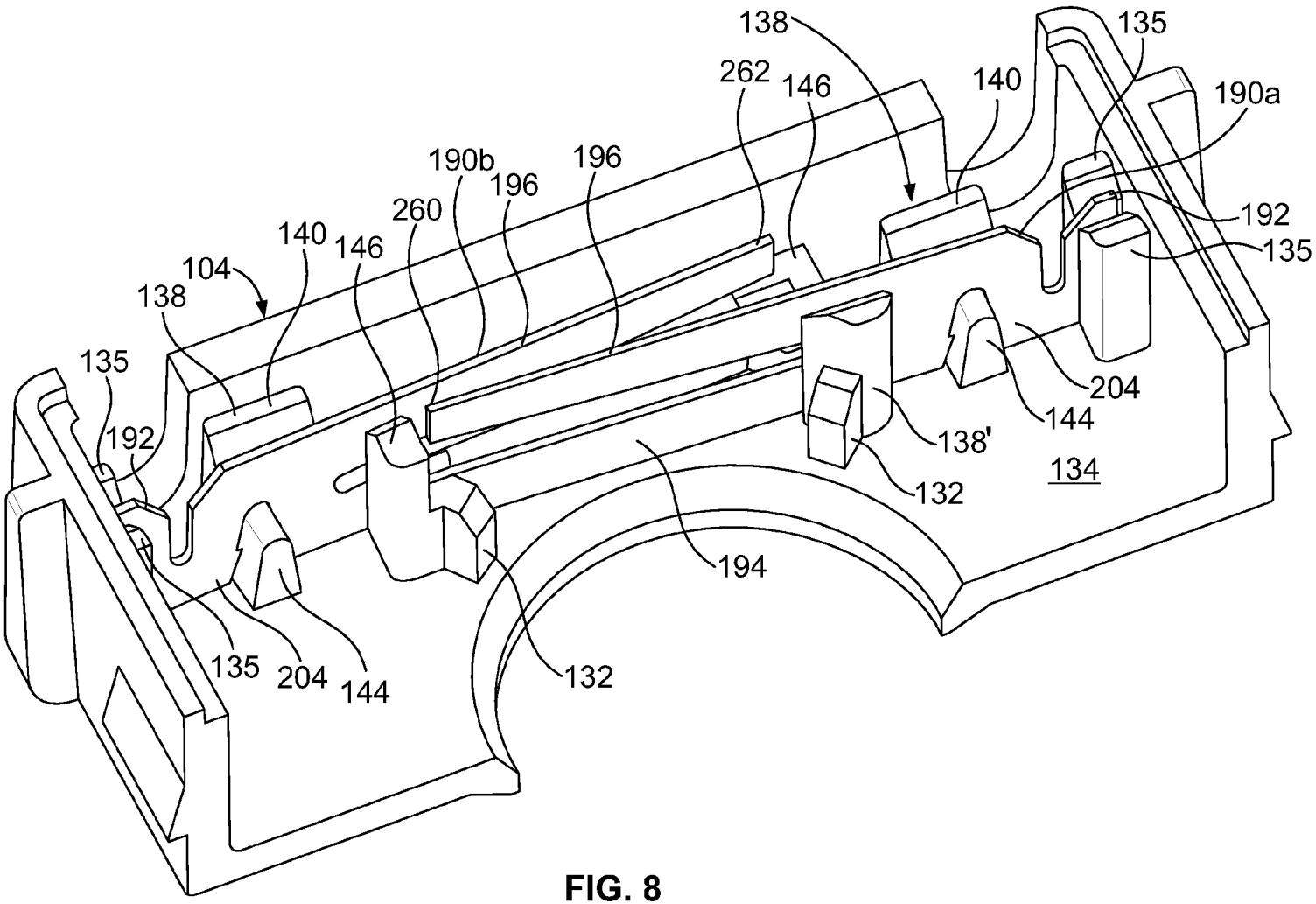
FIG. 8 illustrates an isometric bottom, partial internal view of a cover retaining two ignition contacts, according to an embodiment of the present disclosure.

FIG. 8 illustrates an isometric bottom, partial internal view of the cover 104 retaining two ignition contacts 190*a* and 190*b*, according to an embodiment of the present disclosure. The anchoring end 192 of each ignition contact 190*a* and 190*b* is securely anchored between opposed contact anchors 135. The fixed beam 194 of each ignition contact 190*a* and 190*b* is securely fixed to the cover 104 by the contact retainers 138 and the tip retainers 146. However, the flexible beams 196 of the ignition contacts 190*a* and 190*b* are free to flex toward and away from one another. For example, the flexible beam 196 of the ignition contact 190*a* may pivot about an area proximate to the contact retainer 138'.

As also shown in FIG. 8, the ignition contacts 190*a* and 190*b* are angled in relation to one another. That is, the ignition contacts 190*a* and 190*b* are not parallel with one another. Instead, a distal end 260 of the ignition contact 190*a* is oriented closer to the ignition contact 190*b* than the distal end 262 of the ignition contact 190*b* is to the ignition contact 190*a*.

Figure 9:
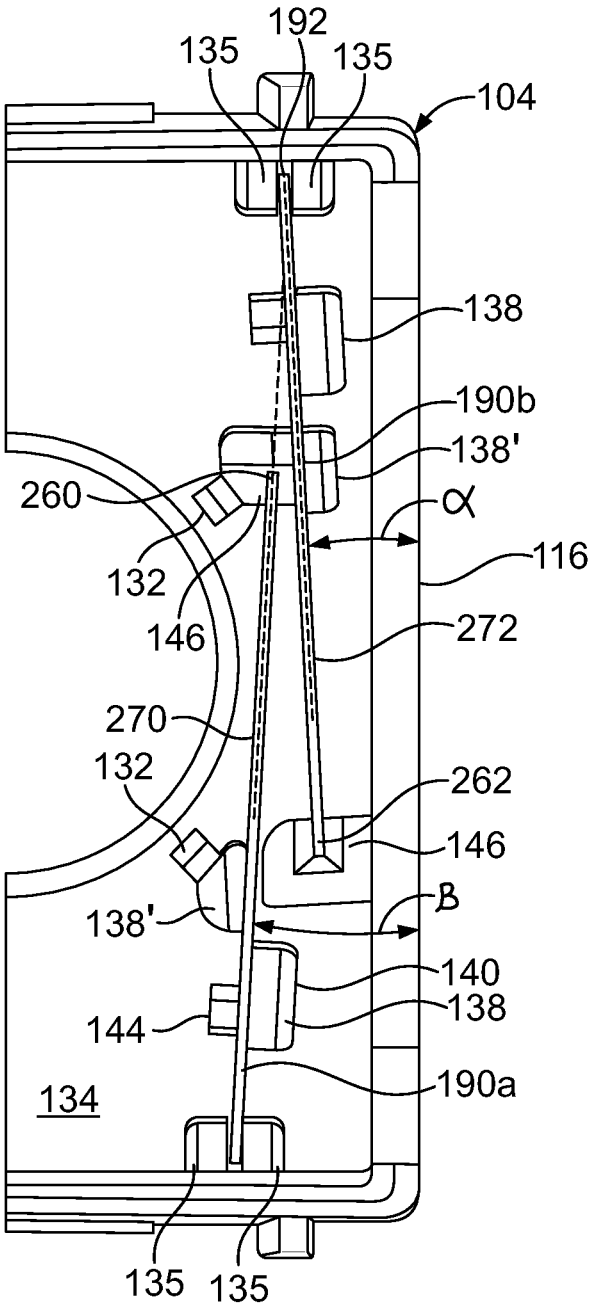
FIG. 9 illustrates a bottom plan view of a cover retaining two ignition contacts, according to an embodiment of the present disclosure.

FIG. 9 illustrates a bottom plan view of the cover 104 retaining the two ignition contacts 190*a* and 190*b*, according to an embodiment of the present disclosure. As shown in FIG. 9, in the at-rest positions, each ignition contact 190*a* and 190*b* is longitudinally aligned in a single, common plane 270 or 272, respectively. That is, in the at-rest position, no portion of either ignition contact 190*a* and 190*b* extends outside of the common plane 270 or 272, respectively. However, as noted above, a small insubstantial portion (such as a bent or curved tip) of the ignition contacts 190*a* and 190*b* may extend outside of the common plane 270 or 272, respectively. Because each ignition contact 190*a* and 190*b* may be formed from a single, planar sheet of material, additional manufacturing processes such as bending, crimping, and or the like may not be employed. As such, the manufacturing time and cost associated with an ignition contact are reduced, as compared to prior contacts that include bends, crimps, and the like.

The ignition contact 190*b* is secured within the cover 104 at an angle α with respect to the side 116. The angle α may be between $1^{0}$-20°, for example. However, the angle α may be more or less than $1^{0}$-20°. For example, the ignition contact 190*b* may be parallel with the side 116.

The ignition contact 190*a* is secured within the cover 104 at an angle β with respect to the side 116. The angle β may be opposite from the angle α. For example, the angle α may be −β. Thus, if the angle β is 20° with respect to the plane of the side 116, the angle α may be −20°, or vice versa. However, the angles α and β may be various other angles other than the parallel with one another. In short, the angle α differs from the angle β. As shown, the distal end 260 of the ignition contact 190*a* is closer to the ignition contact 190*b* than the distal end 262 of the ignition contact 190*b* is to the ignition contact 190*a*. Notably, the planes 270 and 272, if extended from the ignition contacts 190*a* and 190*b*, may intersect proximate to the anchoring end 192 of the ignition contact 190*b*.

Figure 10:
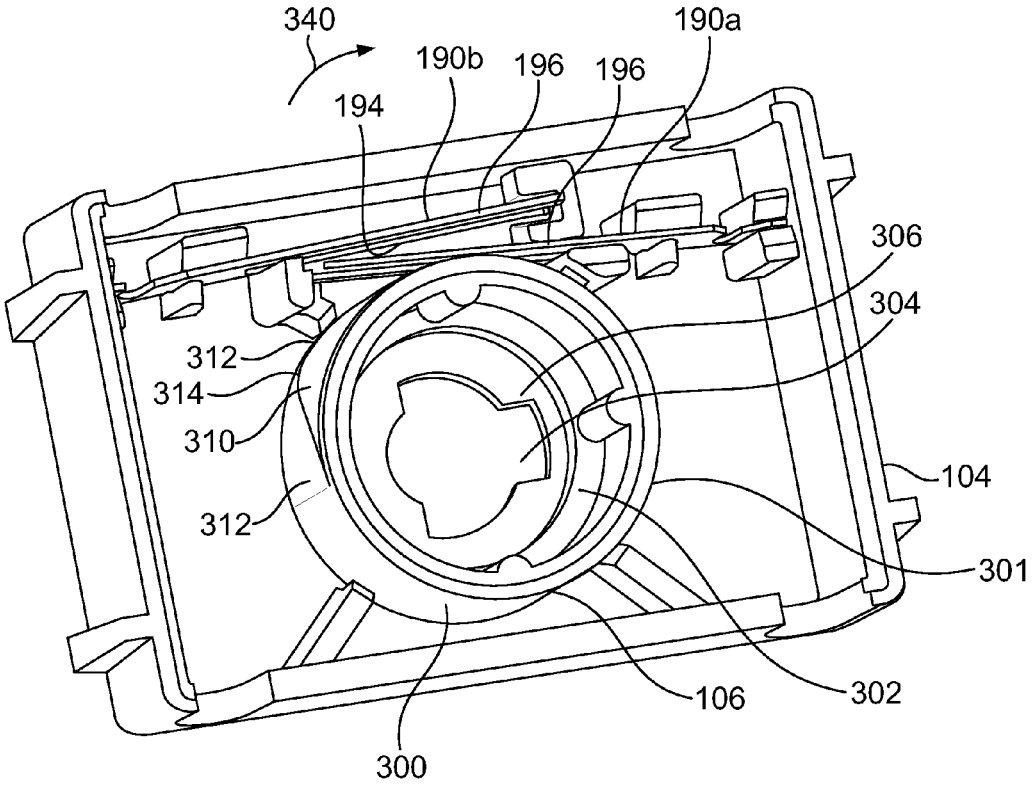
FIG. 10 illustrates an isometric bottom view of a hub in relation to two ignition contacts retained within a cover, according to an embodiment of the present disclosure.

FIG. 10 illustrates an isometric bottom view of the hub 106 in relation to the two ignition contacts 190*a* and 190*b* retained within the cover 104, according to an embodiment of the present disclosure. The hub 106 includes a cylindrical main body 300 defined by a circumferential outer wall 301 having a hollow chamber 302 therein. An opening 304 is formed through a top wall 306 of the hub 106. The opening 304 may be shaped and sized to secure to a reciprocal portion of a gas valve and/or control knob of an appliance, for example. A camming protuberance 310, such as a bump, ridge, stud, rib, or the like, radially extends outwardly from a portion of the circumferential wall 301. The camming protuberance 310 may include ramped wings 312 connected to an apex 314 that extends further away from the circumferential wall 301 than the ramped wings 312. The camming protuberance 310 may be located at the same height as the flexible beams 196 of the ignition contacts 190*a* and 190*b*. The camming protuberance 310 may be above or below the fixed beams 194. As such, the camming protuberance 310 is configured to engage the flexible beam 196 of the ignition contact 190*a*, but not the fixed beam 194.

In operation, when the gas valve to which the hub 106 is operatively connected is turned in the direction of arc 340, the hub 106 rotates in the same direction. The rotation of the hub 106 causes the circumferential wall 301 to slide over an outer surface of the flexible beam 196 of the ignition contact 190*a*. Until the camming protuberance 310 is rotated into engagement with the flexible beam 196 of the ignition contact 190*a*, the flexible beam 196 remains aligned in the common plane with the fixed beam 194. However, when the camming protuberance 310 engages the flexible beam 196, continued urging of the camming protuberance 310 in the direction of arc 340 forces the flexible beam 196 of the ignition contact 190*a* into the flexible beam 196 of the ignition contact 190*b*. Because one or both the ignition contacts 190*a* and 190*b* may be operatively connected to conductive wires, the contact between the flexible beams 196 may generate a spark, which ignites gas emanating from or through the gas valve. As the camming protuberance 310 is rotated further in the direction of arc 340 (or in the opposite direction), the camming protuberance 310 loses contact with the flexible beam 196 of the ignition contact 190*a*, and the flexible beams 196 of the ignition contacts 190*a* and 190*b* lose contact with one another and return to their at-rest positions, as shown in FIG. 10.

Figure 11:
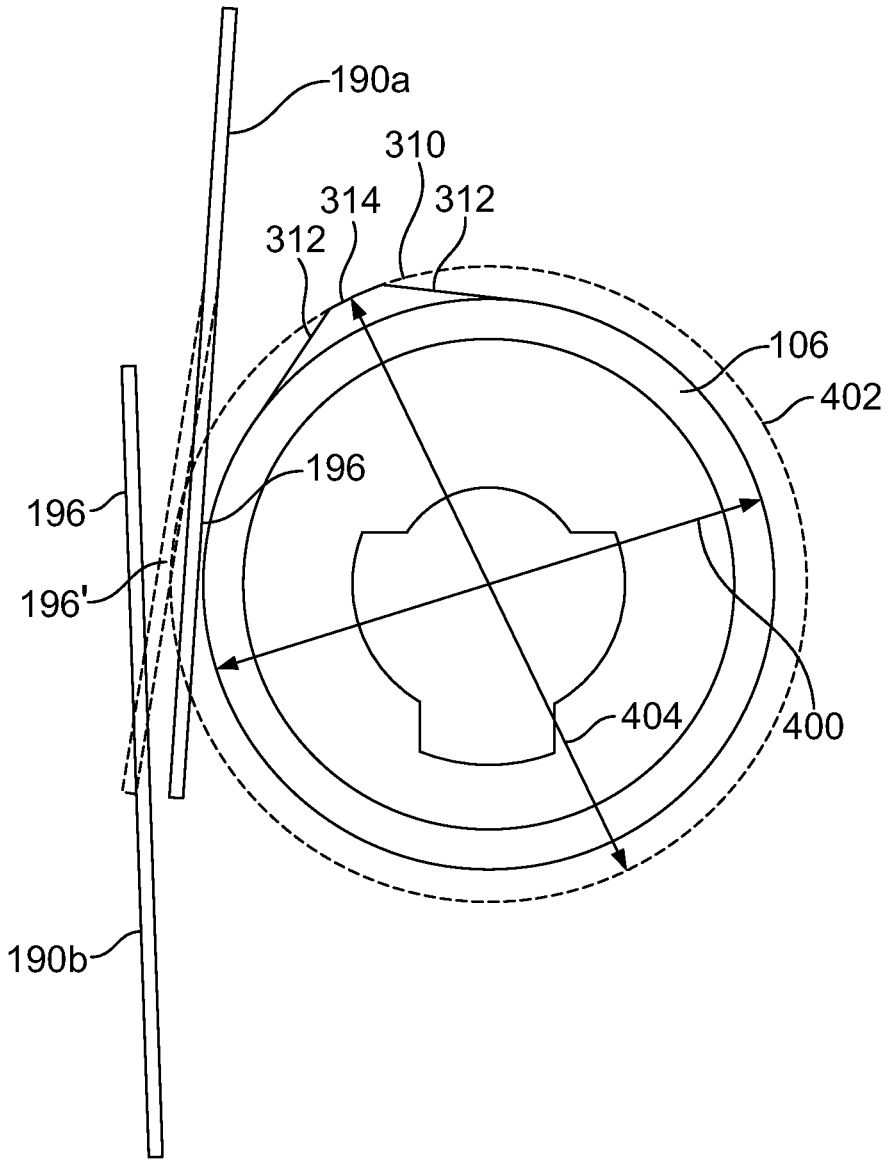
FIG. 11 illustrates a top view of a hub in relation to two ignition contacts, according to an embodiment of the present disclosure.

FIG. 11 illustrates a top view of the hub 106 in relation to the two ignition contacts 190*a* and 190*b*, according to an embodiment of the present disclosure. As shown, the outer circumferential wall 310 of the hub 106 has a diameter 400, which is not long enough to make contact with the flexible beam 196. However, the camming protuberance 310 is configured to be rotated through a sweep envelope 402 having a diameter 404 that contacts the flexible beam 196 and (when the camming protuberance 310 engages the flexible beam 196) bends and forces the flexible beam 196 out of plane into a position 196' that contacts the flexible beam 196 of the ignition contact 190*b*.

As the flexible beam 196 of the ignition contact 190*a* abuts into the flexible beam 196 of the ignition contact 190*b*, the flexible beam 196 of the ignition contact 190*b* may also deflect in response thereto. As such, it has been found that the amount of torque used to rotate the hub 106 may be reduced, as compared to if the ignition contact 190*b* did not include a flexible arm 196.

Referring to FIGS. 8-11, because the ignition contacts 190*a* and 190*b* are angled with respect to one another, the edge or top of the flexible beam 196 of the ignition contact 190*a* is configured to be urged into a planar surface of the flexible beam 196 of the ignition contact 190*b*. That is, the contacting interface between the ignition contacts may be edge-to-planar surface. As such, due to the angled nature of the ignition contacts 190*a* and 190*b* and operation of the camming protuberance 310, the ignition contacts 190*a* and 190*b* may be formed from planar sheets of material, and may not include formed bends. Because the distal tip edge of the flexible beam 196 of the ignition contact 190*a* abuts into the planar surface of the flexible beam 196 of the ignition contact 190*b*, the engagement contact (for example, the edge-to-planar surface interface) therebetween may scrape surface contaminants from the engagement surfaces.

In contrast to previous ignition switches, the ignition contacts 190*a* and 190*b* of the embodiments of the present disclosure may be secured to the cover 104, instead of the base 102. As such, embodiments of the present disclosure may be used with a wide variety of bases that are configured to secure to a wide variety of valves, for example. The cover 104, hub 106, and ignition contacts 190*a* and 190*b* may be removably secured to any base. Because the cover 104 and ignition contacts 190*a* and 190*b* may be common to a wide variety of designs, the cover 104, hub 106, and ignition contacts 190*a* and 190*b* may be pre-assembled and stored for subsequent assembly to a base and/or valve.

Figure 12:
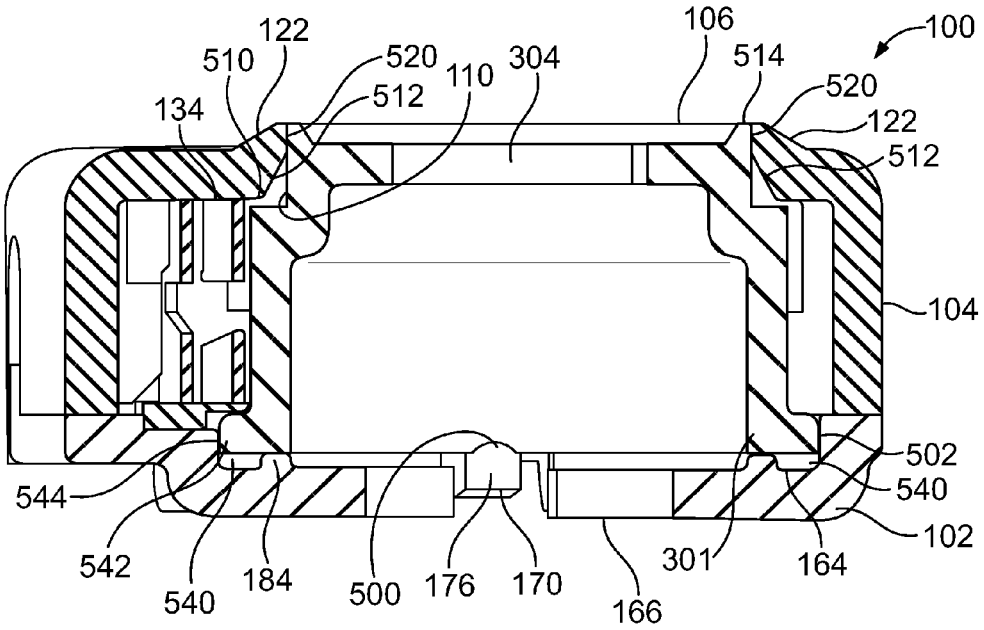
FIG. 12 illustrates a cross-sectional view of an ignition switch assembly through line 12-12 of FIG. 1, according to an embodiment of the present disclosure.

FIG. 12 illustrates a cross-sectional view of the ignition switch assembly 100 through line 12-12 of FIG. 1, according to an embodiment of the present disclosure. As shown in FIG. 12, the hub rotation alignment member 170 radially secures the hub 106 in position. For example, a lower edge of the circumferential wall 301 may be rotatably secured between an interior surface of a protuberance 500 extending from the tip 176 and a retaining wall 502 of the hub retainer 164. The retaining wall 502 and the protuberance 500 may prevent the hub 106 from axially shifting within the ignition switch assembly 100. The guide ribs 184 may be slidably retained within reciprocal channels formed through a bottom end of the hub 106. Alternatively, the guide ribs 184 may merely prop the hub 106 above a base surface of the hub retainer 164. In this manner, as shown in FIG. 12, the bottom of the hub 106 makes minimal contact with the hub retainer 164, thereby reducing friction therebetween, and allowing for a reduced amount of torque to rotate the hub 106.

Additionally, the circumferential wall 301 includes an upper portion 510 that abuts into a bottom surface 134 of the cover 104 surrounding the hub opening 110. Because the upper portion 510 has a diameter that is larger than the hub opening 110, the upper portion 510 is prevented from passing into the hub opening 110. Accordingly, the hub 106 is rotatably secured between the cover 104 and the base 102.

Also, an interior surface 512 of the upstanding rim 122 may angle away from a retained top 514 of the hub 106. The interior surface 512 may contact the retained top 514 at an upper portion 520. Because the interior surface 512 angles away from the retained top 514 and may only make contact at the upper portion 520, the interface between the upstanding rim 122 and the cover 104 may be minimized, thereby allowing for easier and smoother rotation of the hub 106 within the ignition switch assembly 100. Alternatively, the interior surface 512 may not be angled, but may be vertical and make full contact with the retained top 514.

An open drain path may be formed between the opening 304 formed through the hub 106, the hollow chamber 302 of the hub 106, and the central opening 166 formed through the base 102. As such, if water or liquid enters the hub 106, the water or liquid drains through the open drain path and out of the central opening 166. In this manner, water or liquid does not collect within the ignition switch assembly 100, but instead drains directly therethrough. Moreover, the interface between the upstanding rim 122 and the retained top 514 of the hub 106 may be fluid tight. For example, the upstanding rim 122 may sealingly engage the retained top 106, thereby preventing water or liquid from passing therethrough.

Liquid-directing channels 540 may be formed in the hub retainer 164 underneath the hub 106. The liquid-directing channels 540 may be configured to direct water or liquid away from the ignition contacts 190 and/or internal portion of the ignition switch assembly 100. A bottom ledge 542 of the hub 106 within the hub retainer 106 may sealingly and rotatably engage wall portions 544 of the hub retainer 106 to ensure that water does not pass therethrough into the internal portions of the ignition switch assembly 100.

Figure 13:
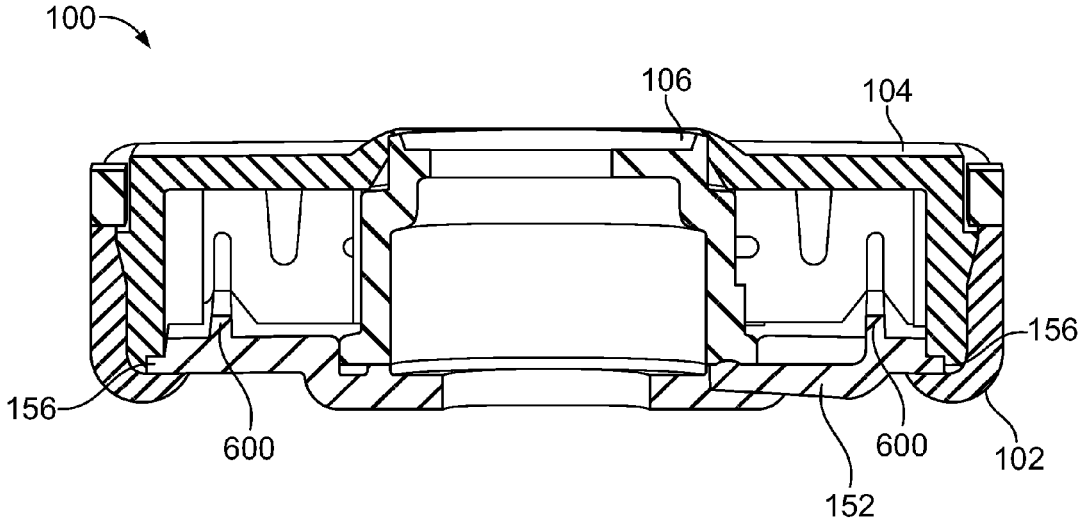
FIG. 13 illustrates a cross-sectional view of an ignition switch assembly through line 13-13 of FIG. 1, according to an embodiment of the present disclosure.

FIG. 13 illustrates a cross-sectional view of the ignition switch assembly 100 through line 13-13 of FIG. 1, according to an embodiment of the present disclosure. As shown in FIG. 13, barrier members 600, such as ribs, posts, columns, walls, or the like, may upwardly extend from the planar wall 152 of the base 102. The barrier members 600 may be proximate to the ends 156. However, the barrier members 600 may be positioned at various other locations of the base 102. The barrier members 600 are configured to block water from passing further into the ignition switch assembly 100. For example, if water or liquid seeps into the ignition switch assembly, the barrier members 600 block the water from infiltrating toward the ignition contacts 190. The barrier members 600 divert the water or liquid away from the central portion of the ignition switch assembly 100 so that the water or liquid may drain through openings formed through the base, such as through the spaces 162 between the upstanding beams 158 (shown in FIGS. 5 and 6).

Figure 14:
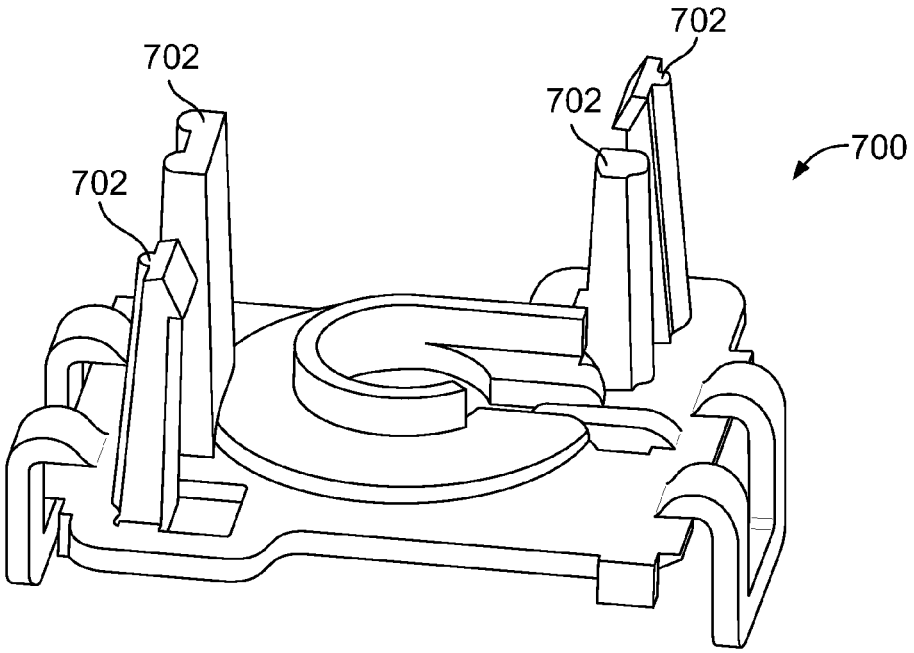
FIG. 14 illustrates an isometric bottom view of a base, according to an embodiment of the present disclosure.

FIG. 14 illustrates an isometric bottom view of a base 700, according to an embodiment of the present disclosure. The base 700 is similar to the base 102, except that the base 700 includes mounting posts 702, such as lugs, extending therefrom. The mounting posts 702 are configured to be retained within reciprocal features of a gas valve, for example. Optionally, the gas valve may include the mounting posts, while the base 700 includes the reciprocal features. The mounting posts 702 ensure proper assembly by preventing the base 700 from being connected to a cover and/or gas valve in an improper direction.

Figure 15:
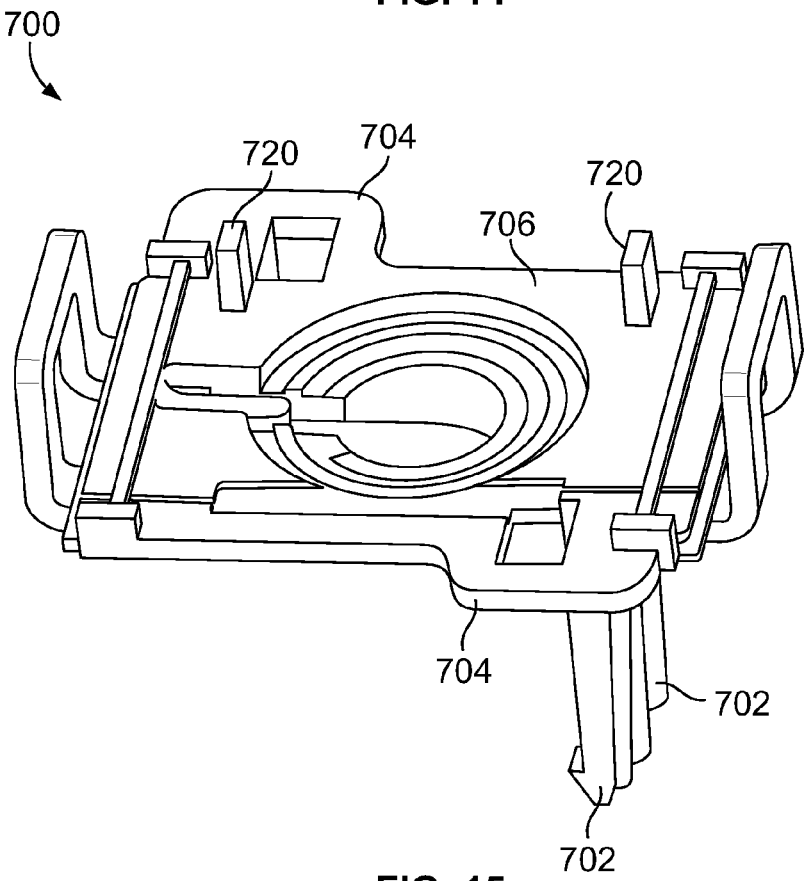
FIG. 15 illustrates an isometric top view of a base, according to an embodiment of the present disclosure.

FIG. 15 illustrates an isometric top view of the base 700 according to an embodiment of the present disclosure. The base 700 may include lateral extensions 704 extending from a planar wall 706. The lateral extensions 704 may be larger or smaller than shown. The base 700 (or 102) may be sized and shaped based on a size and shape of a particular gas valve or control knob to which it is to secure.

Additionally, the base 700 may include orienting lugs 720 at particular locations. The orienting lugs 720 may be configured to mate with reciprocal features of a cover, for example. The orienting lugs 720 may prevent the base 700 from being improperly secured to the cover.

Figure 16:
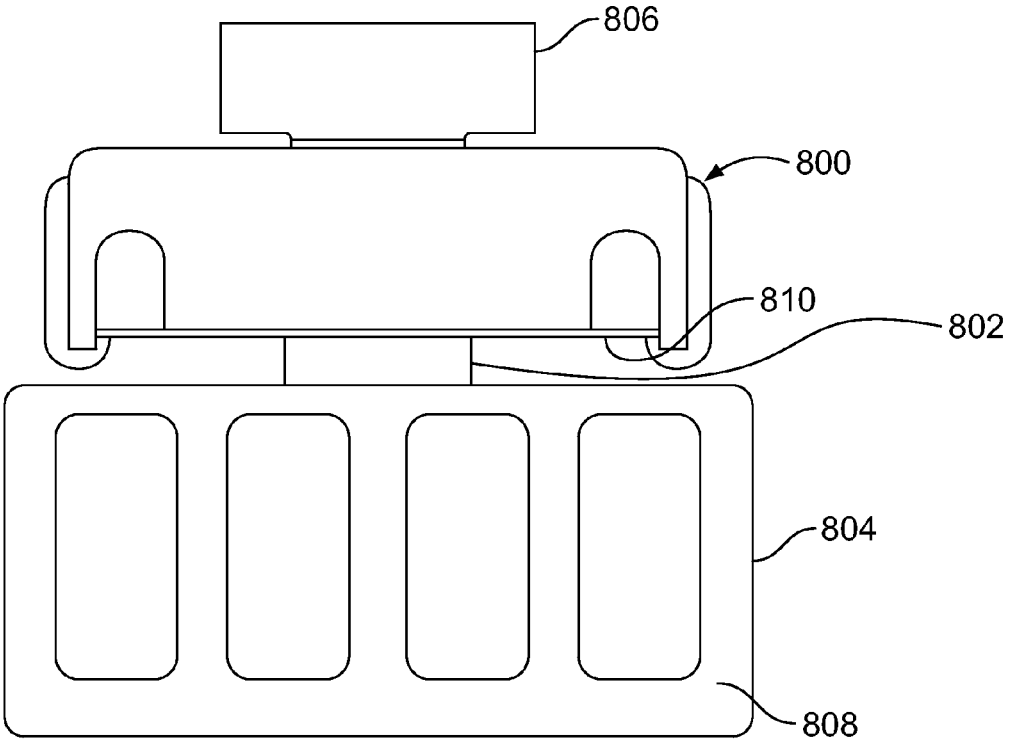
FIG. 16 illustrates a schematic diagram of an ignition switch assembly connected to a gas valve of a burner and a control knob, according to an embodiment of the present disclosure.

FIG. 16 illustrates a schematic diagram of an ignition switch assembly 800 connected to a gas valve 802 of an appliance, such as a burner 804, and a control knob 806, according to an embodiment of the present disclosure. As shown in FIG. 16, a top 808 of the burner 804 is shown, such as may be mounted on a gas range. The ignition switch assembly 800 is operatively connected to the gas valve 802. For example, the gas valve 802 may mount to a base 810 of the ignition switch assembly 800. The control knob 806 is operatively connected to the hub (hidden from view in FIG. 16) within the ignition switch assembly 800. The ignition switch assembly 800 may include any of the components of the assemblies described above.

Figure 17:
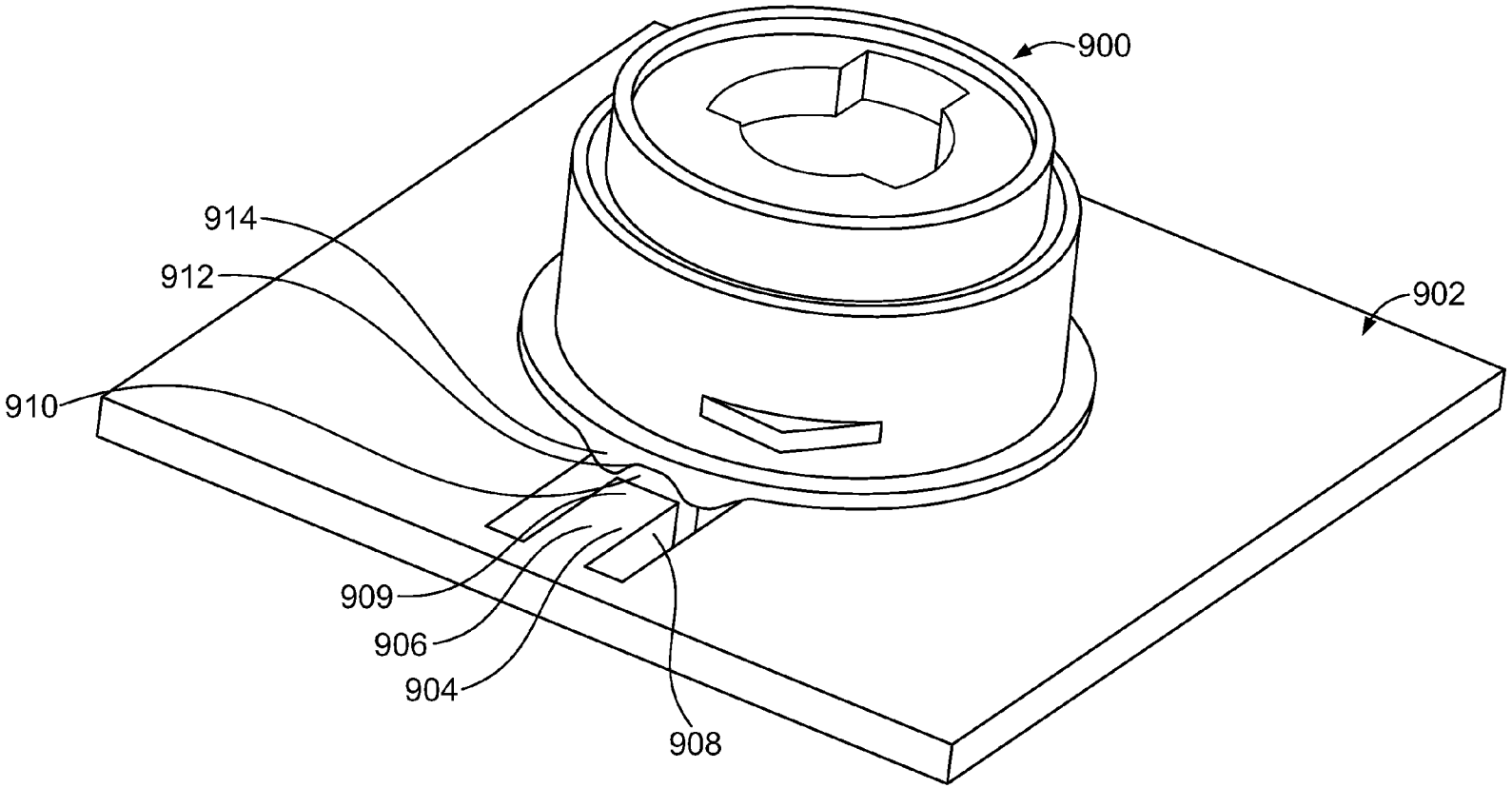
FIG. 17 illustrates an isometric top view of a hub secured to a base, according to an embodiment of the present disclosure.

FIG. 17 illustrates an isometric top view of a hub 900 secured to a base 902, according to an embodiment of the present disclosure. Similar to as described above with respect to FIGS. 4-6, the base 902 may include a hub rotation alignment member 904 that is configured to slidably secure to a portion of the hub 900 in order to provide additional rotational securing alignment with the hub 900. As shown in FIG. 17, the hub rotation alignment member 904 may include an extension beam 906 extending into a channel 908. A distal end 909 of the extension beam 906 may include a protruding bulge 910, such as a bump, tab, stud, or the like, that extends upwardly from the extension beam 906. The protruding bulge 910 nests within a retaining feature, such as a reciprocal channel 912 formed in a circumferential lower edge 914 of the hub 900.

Figure 18:
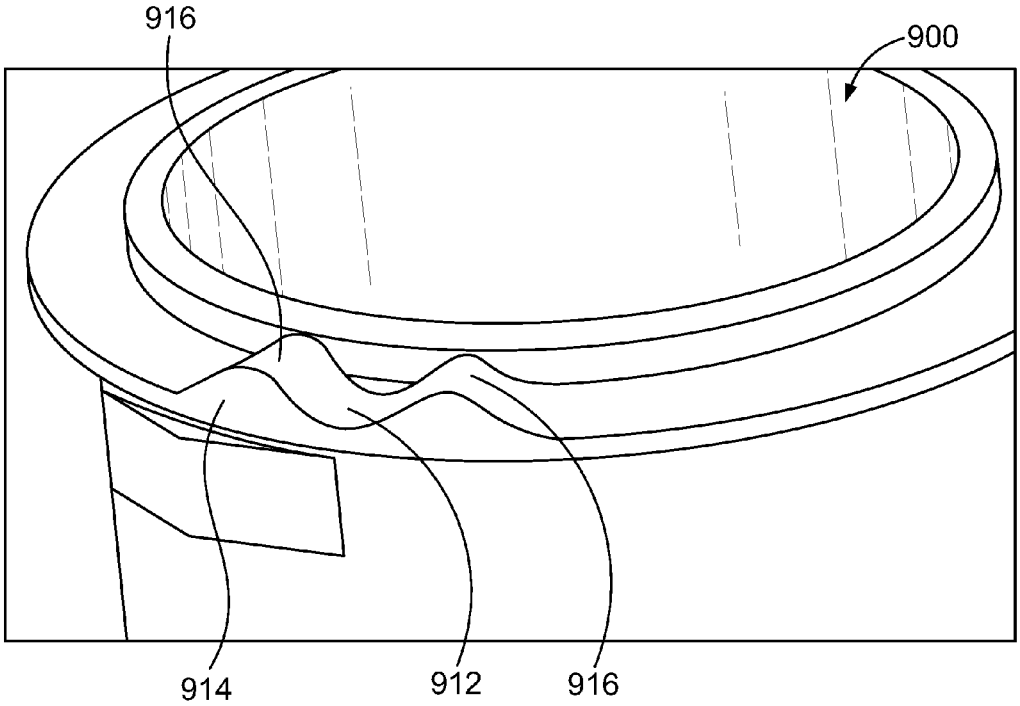
FIG. 18 illustrates an isometric bottom view of a circumferential lower edge of a hub, according to an embodiment of the present disclosure.

FIG. 18 illustrates an isometric bottom view of the circumferential lower edge 914 of the hub 900, according to an embodiment of the present disclosure. As shown, the channel 912 is formed between two raised arcuate protuberances 916 that radially extend downwardly from the circumferential lower edge 914. The protuberances 916 may be sized and shaped the same. Each protuberance 916 may be wave-shaped, as shown in FIG. 18. Alternatively, the protuberances 916 may be sized and shaped differently. For example, each protuberance may be a semi-circular ridge or fin. The protruding bulge 910 of the hub 900 (shown in FIG. 17) is sized and shaped to nest within the reciprocal channel 912.

Figure 19:
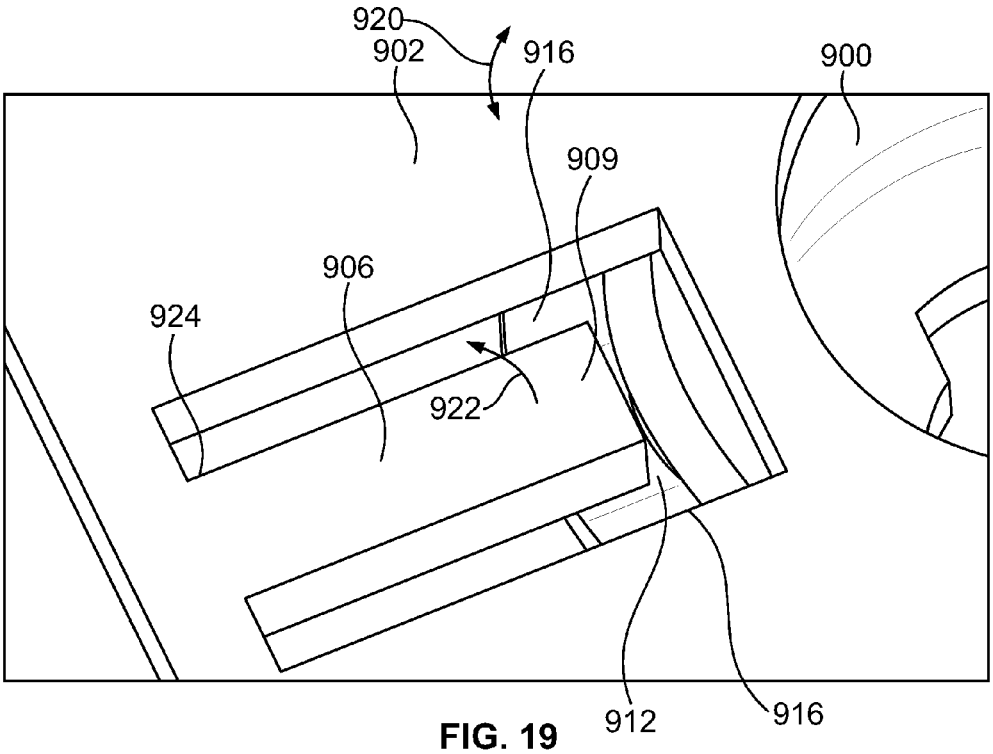
FIG. 19 illustrates a bottom view of a base secured to the hub, according to an embodiment of the present disclosure.

FIG. 19 illustrates a bottom view of the base 902 secured to the hub 900, according to an embodiment of the present disclosure. Referring to FIGS. 17-19, the protruding bulge 910 is shown nested within the reciprocal channel 912 formed between the two protuberances 916. As the hub 900 is rotated in relation to the base 902 in the directions of arc 920, one of the protuberances 916 slides over the protruding bulge 910, thereby forcing the extension beam 906 to deflect downwardly about a flexible pivot connection 924 in the direction of arc 922. As the hub 900 continues to be rotated, the protruding bulge 910 flexes back towards an at-rest position while sliding over an outer surface of the protuberance 916. Once the protuberance 916 is rotated past the protruding bulge 910, the extension beam 906 returns to its at-rest position.

As shown in FIGS. 17 and 19, the hub 900 is connected to the base 902 such that the protruding bulge 910 of the base 902 is securely nested or trapped in the reciprocal channel 912 between the protuberances 916 of the hub 900. As such, the protuberances 916 prevent any undesired rotation of the hub 900 in relation to the base 902. Accordingly, the force exerted by the extension beam 906 into the circumferential lower edge 914 of the hub 900 in the retained position is reduced, due to a lack of a flat interface therebetween. Moreover, the retained relationship between the reciprocal channel 912 and the protruding bulge 910 reduces friction caused by rubbing and excessive torque, thereby preventing wear and tear between the hub 900 and the base 902. In the nested, retained position, as shown in FIGS. 17 and 19, the protruding bulge 910 nested within the reciprocal channel 912 prevents undesired rotation, such as during shipping and handling.

While the hub 900 is shown with a single reciprocal channel 912 formed between two protuberances 916, the hub 900 may include multiple protuberances separated by channels formed around a lower circumferential edge. In this manner, the hub 900 may include multiple retaining positions that may be used to secure the hub 900 in multiple circumferential positions with respect to the base 902.

Embodiments of the present disclosures provide ignition switch assemblies. The ignition switch assemblies may be mounted to gas valves, and the electrical open and closed positions of each ignition switch assembly may be coordinated with gas flow through the valve as the valve stem is rotated. In general, an ignition switch assembly may be mounted on a valve such that a valve stem protrudes through a hub. As the valve stem is rotated, the hub rotates along with the valve stem. The hub may include a camming protuberance that pushes two electrical contacts together, thereby closing a circuit and causing an igniter to spark. The spark is configured to ignite the gas flowing to the burner. Embodiments of the present disclosure may also be used with respect to indicator lights, re-ignition circuits, and the like. In short, embodiments of the present disclosure may be used with respect to any system that is configured to ignite gas.

Embodiments of the present disclosure provide ignition switch assemblies that include uniform ignition contacts. Each ignition contact may be formed in a single stamping operation. Each ignition contact may be formed from a single piece of planar material. The formed ignition contacts may be contained within a single plane, for example. The ignition contacts do not need to be bent or crimped, for example.

The flexible beams or fingers of the ignition contacts are configured to move relative to one another to provide an electrical contact therebetween. The ignition contacts are mounted at an angle with respect to one another. Accordingly, a surface-to-edge contact is achieved when one ignition contact is moved toward the other. The surface-to-edge contact scrapes away contamination from the contacted surface during engagement, provides switching accuracy, and reduces manufacturing variation as both contacts may be sized and shaped the same (as opposed to one of the contacts being bent into a different shape than the other contact).

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present disclosure. It is understood that the embodiments disclosed and defined herein extend to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments to the extent permitted by the prior art.

Various features of the disclosure are set forth in the following claims.

The invention claimed is:

1. An ignition switch assembly configured to be operatively connected to a gas valve, the ignition switch assembly comprising:

a first ignition contact;

a second ignition contact, wherein the first and second ignition contacts are sized and shaped the same;

a hub configured to be rotated, wherein a rotation of the hub in a first direction causes a portion of the first ignition contact to engage the second ignition contact, and wherein further rotation of the hub in the first direction or rotation of the hub in a second direction that is opposite from the first direction causes the portion of the first ignition contact to disengage from the second ignition contact; and a base secured to a cover, wherein the base is configured to mount to the gas valve, wherein the base and the cover define an internal chamber, wherein the first and second ignition contacts and the hub are retained within the internal chamber, wherein the cover comprises contact anchors, contact retainers, and tip retainers configured to retain each of the first and second ignition contacts at a plurality of points of contact.

2. The ignition switch assembly of claim 1, wherein the first and second ignition contacts are angled with respect to one another when the first ignition contact is disengaged from the second ignition contact.

3. The ignition switch assembly of claim 1, wherein the first ignition contact resides within a first linear plane in an at-rest position, and wherein the second ignition contact resides within a second linear plane in an at-rest position.

4. The ignition switch assembly of claim 1, wherein each of the first and second ignition contacts comprises an anchoring end integrally connected to a fixed beam and a flexible beam, wherein the anchoring end and the fixed beam are configured to be fixed in position within the ignition switch assembly, and wherein the portion of the first ignition contact comprises the flexible beam.

5. The ignition switch assembly of claim 1, wherein the first and second ignition contacts are securely retained by the cover.

6. The ignition switch assembly of claim 1, wherein the cover comprises an upstanding rim surrounding a portion of the hub, wherein the upstanding rim is configured to direct liquid away from the hub.

7. The ignition switch assembly of claim 1, wherein the base comprises one or both of a hub retainer and a hub rotation alignment member configured to axially secure the hub.

8. The ignition switch assembly of claim 1, wherein an open drain path is formed between the hub and the base, wherein the open drain path is configured to allow liquid to drain through the ignition switch assembly.

9. The ignition switch assembly of claim 1, wherein the base comprises one or both of liquid-directing channels or barrier members configured to direct liquid away from the first and second ignition contacts.

10. The ignition switch assembly of claim 1, wherein the base comprises one or more mounting lugs configured to ensure that the base is properly connected to the cover and/or the gas valve.

11. The ignition switch assembly of claim 1, wherein the hub comprises a camming protuberance configured to urge the portion of the first ignition contact into the second ignition contact.

12. The ignition switch assembly of claim 1, wherein the base comprises a hub rotation alignment member including at least one protruding bulge, wherein the hub comprises at least one retaining feature including a reciprocal channel formed between two protuberances, and wherein the at least one protruding bulge nests within the at least one reciprocal channel to prevent undesired rotation of the hub with respect to the base.

13. An ignition switch assembly configured to be operatively connected to a gas valve, the ignition switch assembly comprising:

a first ignition contact;

a second ignition contact, wherein the first and second ignition contacts are linear and angled with respect to one another when the first and second ignition contacts are in at-rest positions;

a hub configured to be rotated, wherein a rotation of the hub in a first direction causes a portion of the first ignition contact to engage the second ignition contact, and wherein further rotation of the hub in the first direction or rotation of the hub in a second direction that is opposite from the first direction causes the portion of the first ignition contact to disengage from the second ignition contact; and a base secured to a cover, wherein the base is configured to mount to the gas valve, wherein the base and the cover define an internal chamber, wherein the first and second ignition contacts and the hub are retained within the internal chamber, wherein the base comprises a hub rotation alignment member including at least one protruding bulge, wherein the hub comprises at least one retaining feature including a reciprocal channel formed between two protuberances, and wherein the at least one protruding bulge nests within the at least one reciprocal channel to prevent undesired rotation of the hub with respect to the base.

14. The ignition switch assembly of claim 13, wherein each of the first and second ignition contacts comprises an anchoring end integrally connected to a fixed beam and a flexible beam, wherein the anchoring end and the fixed beam are configured to be fixed in position within the ignition switch assembly, and wherein the portion of the first ignition contact comprises the flexible beam.

15. The ignition switch assembly of claim 13, wherein the cover comprises an upstanding rim surrounding a portion of the hub, wherein the upstanding rim is configured to direct liquid away from the hub.

16. The ignition switch assembly of claim 13, wherein an open drain path is formed between the hub and the base, wherein the open drain path is configured to allow liquid to drain through the ignition switch assembly.

17. The ignition switch assembly of claim 13, wherein the hub comprises a camming protuberance configured to urge the portion of the first ignition contact into the second ignition contact.

18. The ignition switch assembly of claim 13, wherein the first and second ignition contacts are securely retained by the cover.

19. An ignition switch assembly configured to be operatively connected to a gas valve, the ignition switch assembly comprising:

a base configured to mount to the gas valve, wherein the base comprises a hub rotation alignment member including at least one protruding bulge;

a cover secured to the base, wherein the base and the cover define an internal chamber, wherein the cover comprises an upstanding rim surrounding a hub opening, wherein the upstanding rim is configured to direct liquid away from the hub opening;

a first ignition contact securely retained by the cover within the internal chamber, wherein the first ignition contact resides within a first linear plane in an at-rest position, wherein the first ignition contact comprises a first anchoring end integrally connected to a first fixed beam and a first flexible beam, and wherein the first anchoring end and the first fixed beam are configured to be fixed in position within the ignition switch assembly;

a second ignition contact securely retained by the cover within the internal chamber, wherein the second ignition contact resides within a second linear plane in an at-rest position, wherein the second ignition contact comprises a second anchoring end integrally connected to a second fixed beam and a second flexible beam, wherein the second anchoring end and the second fixed beam are configured to be fixed in position within the ignition switch assembly, wherein the first and second ignition contacts are sized and shaped the same, and wherein the first and second ignition contacts are linear and angled with respect to one another when the first and second ignition contacts are in the at-rest positions; and a hub rotatably secured within the internal chamber and having at least a portion rotatably secured within the hub opening, wherein the hub comprises at least one retaining feature including a reciprocal channel formed between two protuberances, and wherein the at least one protruding bulge nests within the at least one reciprocal channel to prevent undesired rotation of the hub with respect to the base, wherein the hub further comprises a camming protuberance configured to urge the first flexible beam of the first ignition contact into the second flexible beam of the second ignition contact, wherein a rotation of the hub in a first direction causes the first flexible beam of the first ignition contact to engage the second flexible beam of the second ignition contact, wherein further rotation of the hub in the first direction or rotation of the hub in a second direction that is opposite from the first direction causes the first flexible beam of the first ignition contact to disengage from the second flexible beam of the second ignition contact, wherein an open drain path is formed between the hub and the base, and wherein the open drain path is configured to allow liquid to drain through the ignition switch assembly.

20. An ignition switch assembly configured to be operatively connected to a gas valve, the ignition switch assembly comprising:

a first ignition contact;

a second ignition contact, wherein the first and second ignition contacts are sized and shaped the same;

a hub configured to be rotated, wherein a rotation of the hub in a first direction causes a portion of the first ignition contact to engage the second ignition contact, and wherein further rotation of the hub in the first direction or rotation of the hub in a second direction that is opposite from the first direction causes the portion of the first ignition contact to disengage from the second ignition contact; and a base secured to a cover, wherein the base is configured to mount to the gas valve, wherein the base and the cover define an internal chamber, wherein the first and second ignition contacts and the hub are retained within the internal chamber, wherein the base comprises a hub rotation alignment member including at least one protruding bulge, wherein the hub comprises at least one retaining feature including a reciprocal channel formed between two protuberances, and wherein the at least one protruding bulge nests within the at least one reciprocal channel to prevent undesired rotation of the hub with respect to the base.

21. The ignition switch assembly of claim 20, wherein the first and second ignition contacts are securely retained by the cover.

22. The ignition switch assembly of claim 20, wherein the cover comprises an upstanding rim surrounding a portion of the hub, wherein the upstanding rim is configured to direct liquid away from the hub.

23. The ignition switch assembly of claim 20, wherein an open drain path is formed between the hub and the base, wherein the open drain path is configured to allow liquid to drain through the ignition switch assembly.

24. The ignition switch assembly of claim 20, wherein the base comprises one or both of liquid-directing channels or barrier members configured to direct liquid away from the first and second ignition contacts.

* * * * *